United States Patent [19]

de Nora et al.

[11] 4,272,354

[45] Jun. 9, 1981

[54] ELECTRODES FOR ELECTROLYTIC PROCESSES

[75] Inventors: Vittorio de Nora, Nassau, The Bahamas; Antonio Nidola, Milan, Italy; Placido M. Spaziante, Lugano, Switzerland; Giuseppe Bianchi, Milan, Italy

[73] Assignee: Diamond Shamrock Technologies, S.A., Geneva, Switzerland

[21] Appl. No.: 97,346

[22] Filed: Nov. 26, 1979

[51] Int. Cl.[3] ..... C25B 11/06; C25B 11/10

[52] U.S. Cl. ..... 204/290 R; 204/291; 204/292

[58] Field of Search ..... 204/290 R, 291

[56] References Cited

U.S. PATENT DOCUMENTS 3,718,550 2/1973 Klein ..... 204/291

*Primary Examiner*—Howard S. Williams

*Attorney, Agent, or Firm*—John P. Hazzard

[57] ABSTRACT

Electrodes for electrolytic processes comprise an electrically-conductive and corrosion-resistant substrate, having a coating thereon which contains a solid solution of tin dioxide and bismuth trioxide, preferably in a ratio of 9:1 to 4:1 by weight of the respective metals. This solid solution may form the active coating or an intermediate layer covered with other electrocatalytic materials or may be included in a multi-component coating having selective properties for halogen evolution and oxygen inhibition.

7 Claims, 5 Drawing Figures

(Na2SO4 SOLUTION AT 60°C)
oxygen evolution potential V(NHE)
2.0
1.9
1.8
1.7
1.6
1.5
2,3
4,5
1,6,7
1000
5000
10000
curr. density(A/m2)

(DILUTE NaCl/Na2SO4 SOLUTION AT 15°C)
anodic potential V(NHE)
2.0
1.9
1.8
1.7
1.6
1.5
2,3
1,4,5,6,7
100
iL(Cl2)
500
1000
curr. density(A/m2)

(DILUTE NaCl/Na2SO4 SOLUTION AT 15°C)
oxygen evolution faraday efficiency (%)
25
20
15
10
5
1
3
100
200
300
400
500
curr. density (A/m2)

(Na2SO4 SOLUTION AT 60°C)
oxygen evolution potential V(NHE)
2.0
1.9
1.8
1.7
1.6
1.5
1.4
9
10
3
8
1
1000
5000
10000
curr. density (A/m2)

ELECTRODES FOR ELECTROLYTIC PROCESSES

TECHNICAL FIELD

The invention relates to electrodes for use in electrolytic processes, of the type comprising an electrically-conductive and corrosion-resistant substrate having a coating containing tin dioxide, and to electrolytic processes using such electrodes.

BACKGROUND ART

Various types of tin dioxide coated electrodes are known.

U.S. Pat. No. 3,627,669 describes an electrode comprising a valve metal substrate having a surface coating consisting essentially of a semiconductive mixture of tin dioxide and antimony trioxide. A solid-solution type surface coating comprising titanium dioxide, ruthenium dioxide and tin dioxide is described in U.S. Pat. No. 3,776,834 and a multi-component coating containing tin dioxide, antimoy trioxide, a valve metal oxide and a platinum group metal oxide is disclosed in U.S. Pat. No. 3,875,043.

Another type of coating, described in U.S. Pat. No. 3,882,002 uses tin dioxide as an intermediate layer, over which a layer of a noble metal or a noble metal oxide is deposited. Finally, U.S. Pat. No. 4,028,215 describes an electrode in which a semiconductive layer of tin dioxide/antimony trioxide is present as an intermediate layer and is covered by a top coating consisting essentially of manganese dioxide.

DISCLOSURE OF INVENTION

Broadly, the invention provides an electrode of the above-indicated type, having a coating containing tin dioxide enhanced by the addition of bismuth trioxide.

Thus, according to the invention, an electrode for electrolytic processes comprises an electrically-conductive and corrosion-resistant substrate having a coating containing a solid solution of tin oxide and bismuth trioxide. Preferably, the solid solution forming the coating is made by codeposition of a mixture of tin and bismuth compounds which are converted to the respective oxides. The tin dioxide and bismuth trioxide are advantageously present in the solid solution in a ratio of from about 9:1 to 4:1 by weight of the respective metals. However, in general useful coatings may have a Sn:Bi ratio ranging from 1:10 to 100:1. Possibly, there is an excess of tin dioxide present, so that a part of the tin dioxide is undoped, i.e. it does not form part of the $SnO_2.Bi_2O_3$ solid solution, but is present as a distinct phase.

The electrically-conductive base is preferably one of the valve metals, i.e. titanium, zirconium, hafnium, vanadium, niobium and tantalum, or it is an alloy containing at least one of these valve metals. Valve metal carbides and borides are also suitable. Titanium metal is preferred because of its low cost and excellent properties.

In one preferred embodiment of the invention, the electrode coating consists essentially of the $SnO_2.Bi_2O_3$ solid solution applied in one or more layers on a valve metal substrate. This type of coating is useful in particular for the electrolytic production of chlorates and perchlorates, but for other applications the coating may desirably be modified by the addition of a small quantity of one or more specific electrocatalytic agents.

In another preferred embodiment, a valve metal substrate is coated with one or more layers of the $SnO_2.Bi_2O_3$ solid solution and this or these layers are then covered by one or more layers of an electrocatalytic material, such as (a) one or more platinum group metals, i.e. ruthenium, rhodium, palladium, osmium, iridium and platinum, (b) one or more platinum group metal oxides, (c) mixtures or mixed crystals of one or more platinum group metal oxides with one or more valve metal oxides, and (d) oxides of metals from the group of chromium, molybdenum, tungsten, manganese, iron, cobalt, nickel, lead, germanium, antimony, aresenic, zinc, cadmium, selenium and tellurium. The layers of $SnO_2.Bi_2O_3$ and the covering electrocatalytic material may optionally contain inert binders, for instance, such materials as silica, alumina or zirconium silicate.

In yet another embodiment, the $SnO_2.Bi_2O_3$ solid solution is mixed with one or more of the above-mentioned electrocatalytic materials (a) to (d), with an optional binder and possible traces of other electrocatalysts, this mixture being applied to the electrically-conductive substrate in one or more codeposited layers.

A preferred multi-component coating of the latter type has ion-selective properties for halogen evolution and oxygen inhibition and is thus useful for the electrolysis of alkali metal halides to form halogen whenever there is a tendency for undesired oxygen evolution, i.e. especially when sulphate ions are present in the electrolyte or when dilute brines, such as sea water, are being electrolyzed.

This preferred form of electrode has a multi-component coating comprising a mixture of (i) ruthenium dioxide as primary halogen catalyst, (ii) titanium dioxide as catalyst stabilizer, (iii) the tin dioxide/bismuth trioxide solid solution as oxygen-evolution inhibitor, and (iv) cobalt oxide ($Co_3O_4$) as halogen promoter. These components are advantageously present in the following proportions, all in parts by weight of the metal or metals; (i) 30–50; (ii) 30–60; (iii) 5–15; and (iv) 1–6.

The main applications of electrodes with these multi-component coatings include seawater electrolysis, even at low temperature, halogen evolution from dilute waste waters, electrolysis of brine in mercury cells under high current density (above 10 $KA/m^2$), electrolysis with membrane or SPE cell technology, and organic electrosynthesis.

For electrodes used in SPE (solid-polymer electrolyte) cell and related technology, instead of being directly applied to the substrate, the active coating material is applied to or incorporated in a hydraulically and/or ionically permeable separator, typically an ion-exchange membrane, and the electrode substrate is typically a grid of titanium or other valve-metal which is brought into contact with the active material carried by the separator.

BEST MODES FOR CARRYING OUT THE INVENTION

The following Examples are given to illustrate the invention.

EXAMPLE I

A series of anodes was prepared as follows. Titanium coupons measuring 10×10×1 mm were sandblasted and etched in 20% hydrochloric acid and thoroughly washed in water. The coupons were then brush coated with a solution in ethanol of ruthenium chloride and orthobutyl titanate (coupon 1), the coating solution also containing stannic chloride and bismuth trichloride for nine coupons (coupons 2–10) and, in addition, cobalt chloride for four coupons (coupons 11–14). Each coating was dried at 95° to 100° C. and the coated coupon was then heated at 450° C. for 15 minutes in an oven with forced air ventilation. This procedure was repeated 5 times and the coupons were then subjected to a final heat treatment at 450° C. for 60 minutes. The quantities of the components in the coating solutions were varied so as to give the final coating compositions shown in Table I, all quantities being in % by weight of the respective metals to the total metal content.

TABLE I

| Coupon/Anode | $RuO_2$ | $TiO_2$ | $SnO_2/Bi_2O_3$ | Sn/Bi | $Co_3O_4$ |
|---|---|---|---|---|---|
| 1 | 45 | 55 | — | — | — |
| 2 | 45 | 50 | 5.0 | 9:1 | — |
| 3 | 45 | 50 | 5.0 | 4:1 | — |
| 4 | 45 | 50 | 5.0 | 1:1 | — |
| 5 | 45 | 50 | 5.0 | 1:9 | — |
| 6 | 45 | 50 | 5.0 | 10:0 | — |
| 7 | 45 | 50 | 5.0 | 0:10 | — |
| 8 | 45 | 54 | 1.0 | 4:1 | — |
| 9 | 45 | 45 | 10 | 4:1 | — |
| 10 | 45 | 35 | 20 | 4:1 | — |
| 11 | 45 | 44 | 10 | 4:1 | 1.0 |
| 12 | 45 | 42.5 | 10 | 4:1 | 2.5 |
| 13 | 45 | 40 | 10 | 4:1 | 5 |
| 14 | 45 | 39 | 10 | 4:1 | 6 |

Figure 1:
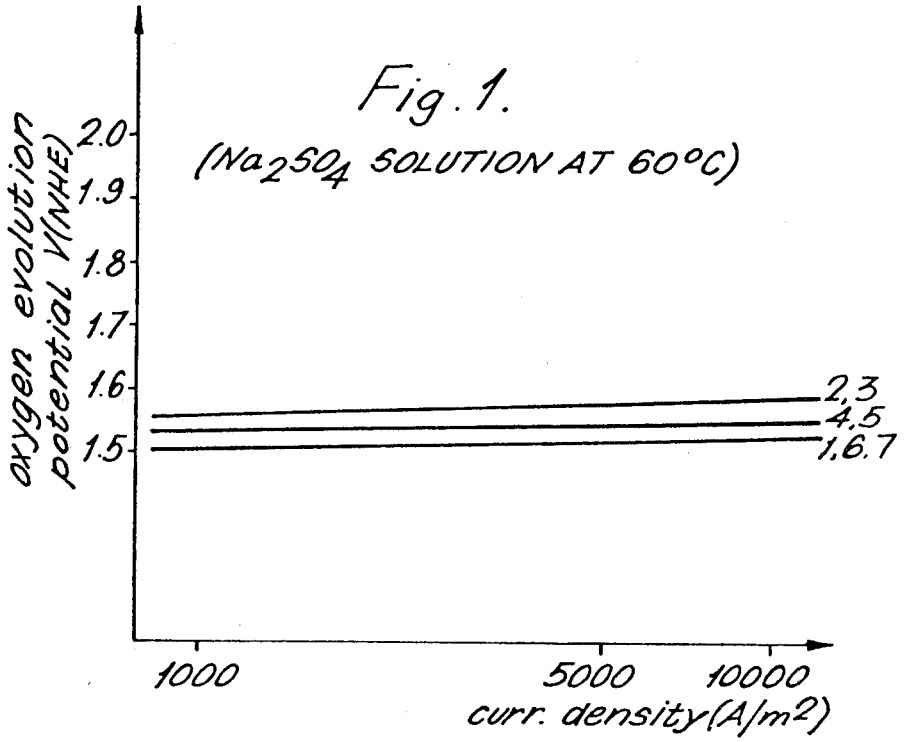
FIG. 1 shows a graph in which oxygen evolution potential as ordinate is plotted against current density as abscissa, for seven of the anodes described in detail in Example I below.

Coupons 1–7 were tested as anodes for the electrolysis of an aqueous solution containing 200 g/l of $Na_2SO_4$ at 60° C. and current densities up to 10 KA/m$^2$. FIG. 1 is an anodic polarization curve showing the measured oxygen evolution potentials. It can be seen that anodes 2–5, which including the $SnO_2.Bi_2O_3$ mixture, have a higher oxygen evolution potential than anode 1 (no $SnO_2$ or $Bi_2O_3$), anode 6 ($SnO_2$ only) and anode 7 ($Bi_2O_3$ only). Anodes 2 and 3 show the highest oxygen evolution potentials. It is believed that this synergistic effect of the $SnO_2.Bi_2O_3$ mixed crystals or mixtures may be due to the fact that $SnO_2.Bi_2O_3$ blocks OH radicals through the formation of stable persalt complexes, thus hindering oxygen evolution.

The chlorine evolution potential of anodes 1–10 was measured in saturated NaCl solutions up to 10 KA/m$^2$ and was found not to vary as a function of the presence or absence of $SnO_2.Bi_2O_3$.

Figure 2:
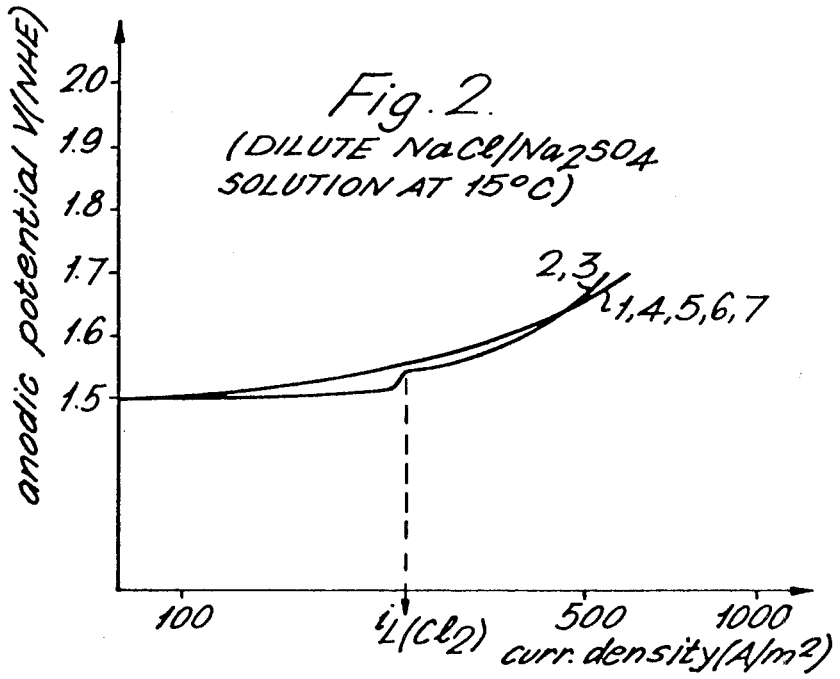
FIG. 2 shows a graph in which anodic potential as ordinate is plotted against current density as abscissa, for the same seven anodes.

FIG. 2 shows the anodic potential of coupons 1–7 in dilute $NaCl/Na_2SO_4$ solutions (10 g/l NaCl, 5 g/l $Na_2SO_4$) at 15° C., at current densities up to about 500 A/m$^2$. In these conditions, coupons 2 and 3 exhibit a measurable chlorine evolution limit current $i_{L(CL_2)}$.

Figure 3:
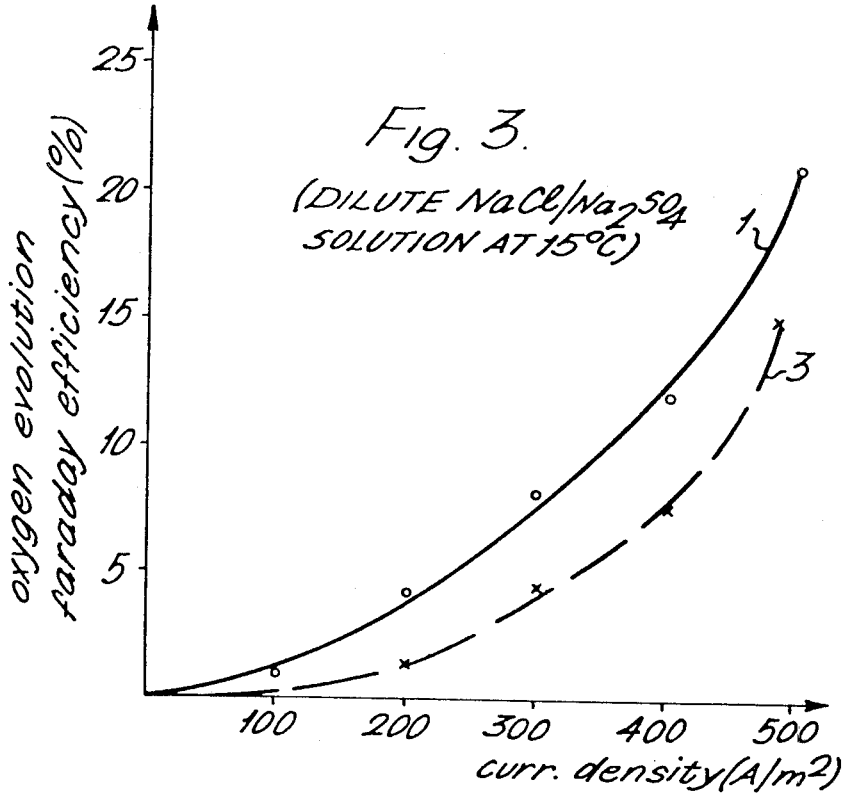
FIG. 3 shows a graph in which oxygen evolution faraday efficiency as ordinate is plotted against current density as abscissa, for two of the anodes.

FIG. 3 shows the oxygen evolution faraday efficiency of anodes 1 and 3 as a function of current density in this dilute $NaCl/Na_2SO_4$ solution at 15° C. This graph clearly shows that anode 3 has a lower oxygen faraday efficiency than anode 1, and therefore preferentially evolves chlorine.

Figure 4:
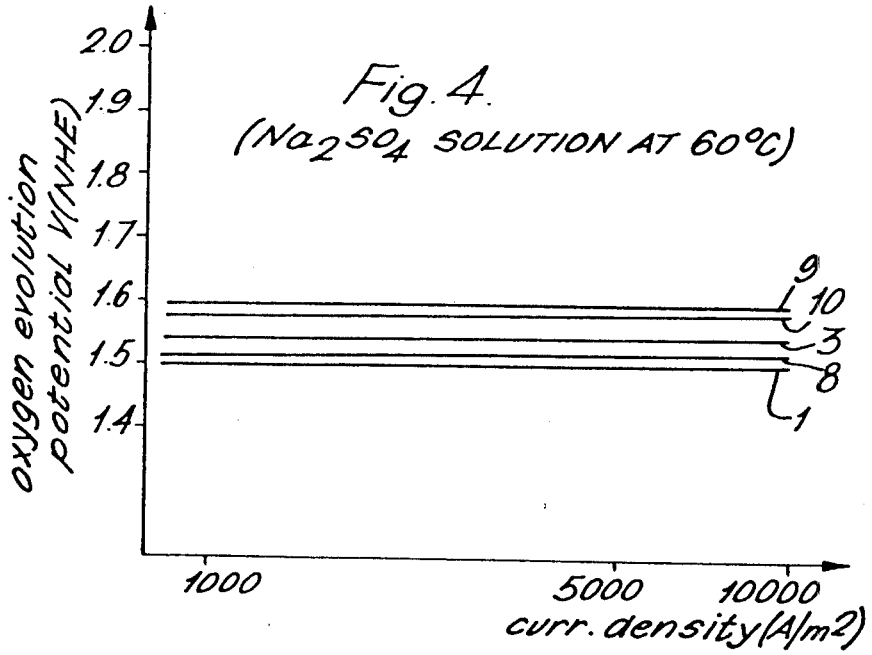
FIG. 4 shows a graph similar to FIG. 1 in which oxygen evolution potential as ordinate is plotted against current density as abscissa, for five of the anodes described in detail in Example I below.

FIG. 4 is similar to FIG. 1 and shows the oxygen evolution potentials of anodes 1, 3, 8, 9 and 10 under the same conditions as in FIG. 1, i.e. a solution of 200 g/l $Na_2SO_4$ at 60° C. This graph shows that in these conditions anode 9 with an $SnO_2.Bi_2O_3$ content of 10% (by metal) has an optimum oxygen-inhibition effect.

Table II shows the anodic potential gap between the unwanted oxygen evolution side reaction and the wanted chlorine evolution reaction calculated on the basis of the measured anodic potentials at 10 KA/m$^2$ in saturated NaCl solution and $Na_2SO_4$ solution for electrodes 1, 8, 3, 9 and 10.

TABLE II

| Coupon/ Anode | Amount of $SnO_2$. $Bi_2O_3$ (% as metal) | $Cl_2$ Evolution Potential V(NHE) | $O_2$ Evolution Potential V(NHE) | Δ ($O_2$—$Cl_2$) (mv) | Remarks |
|---|---|---|---|---|---|
| 1 | — | 1.36 | 1.52 | 160 | Standard selectivity |
| 8 | 1 | 1.36 | 1.54 | 180 | Improved selectivity |
| 3 | 5 | 1.36 | 1.57 | 210 | Improved selectivity |
| 9 | 10 | 1.36 | 1.61 | 250 | Improved selectivity |
| 10 | 20 | 1.36 | 1.60 | 240 | Improved selectivity |

The presence of a low percentage of $Co_3O_4$ (coupons 11–14) is found, from anodic polarization curves in saturated NaCl up to 10 KA/m$^2$, to lower the chlorine evolution potential without influence on the oxygen evolution potential (notably without increasing it) as measured in the electrolysis of a 200 g/l $Na_2SO_4$ solution at 60° C.

Figure 5:
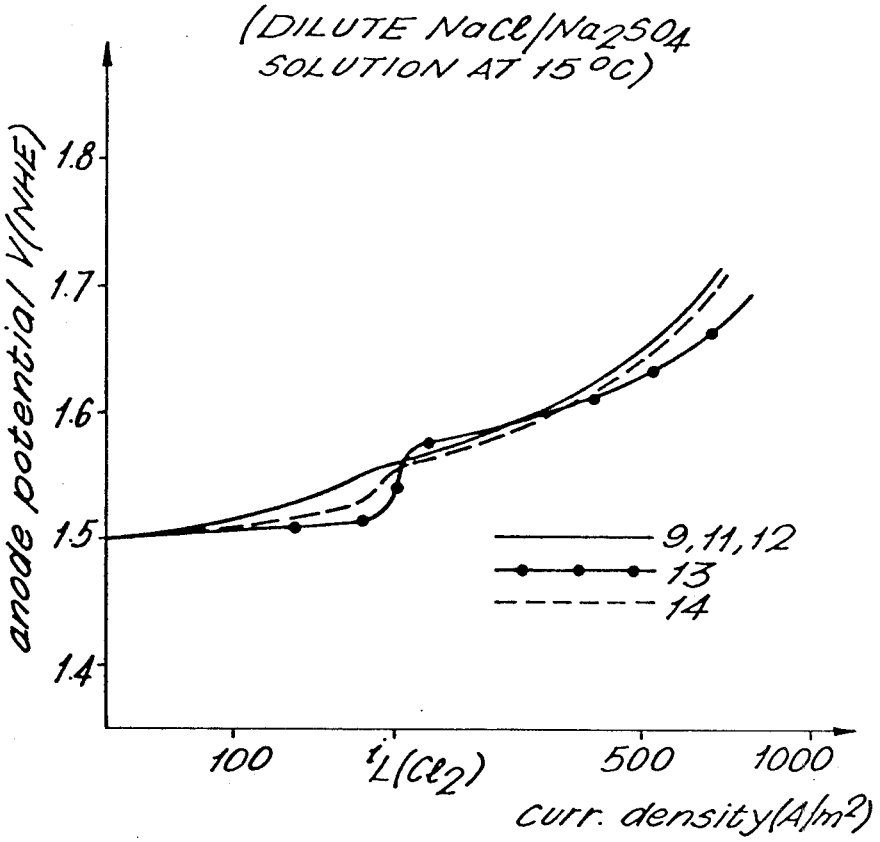
FIG. 5 shows a graph similar to FIG. 2 in which anodic potential as ordinate is plotted against current density as abscissa, for five of the anodes described in detail in Example I below.

FIG. 5 is a graph, similar to FIG. 2, showing the anodic potential of coupons 9, 11, 12, 13 and 14 measured in a solution of 10 g/l NaCl and 5 g/l $Na_2SO_4$ at 15° C. In these conditions, it can be seen from the graph that the presence of $Co_3O_4$ decreases the potential up to the limit chlorine evolution current $i_{L(Cl_2)}$ and therefore increases the $Cl_2/O_2$ ratio up to this limit. This effect of the $Co_3O_4$ is greatest up to a threshold cobalt content of about 5%.

It is believed that the $Co_3O_4$ additive may play two roles. Firstly, it helps the $RuO_2$ to catalyze chlorine evolution, probably by the formation and decompsition of an active surface complex such as $Co^{III}OCl$. Secondly, it increases the electrical conductivity of the coating, probably by an octahedral-tetrahedral lattice exchange reaction $Co^{III}+e \rightleftarrows Co^{II}$.

EXAMPLE II

Titanium anode bases were coated using a procedure similar to that of Example I, but with coating compositions containing the appropriate thermodecomposable salts to provide coatings with the compositions set out below in Table III, the intermediate layers being first applied to the anode bases, and then covered with the indicated top layers. All coatings were found to have selective properties with a low chlorine overpotential, high oxygen overpotential and low catalytic ageing rate. As before, all quantities in Table III are given in % by weight of the respective metal to the total metal content of the entire coating.

TABLE III

| Anode/Coupon | Intermediate Layer | Top Layer |
|---|---|---|
| 15 | $SnO_2 . Bi_2O_3$ | $TiO_2/RuO_2/NiO_x$ |
| | 3.75 (Sn/Bi 6.5:1) | 50/45/1.25 |
| 16 | $SnO_2 . Bi_2O_3$ | $TiO_2/RuO_2$ |
| | 10 (Sn/Bi 9:1) | 45/45 |
| 17 | $SnO_2 . Bi_2O_3$ | Pt (metal) |
| | 10 (Sn/Bi 4:1) | 90 |
| 18 | $SnO_2 . Bi_2O_3$ | Pd (metal)/ Pt (metal) |
| | 10 (Sn/Bi 4:1) | 10/80 |
| 19 | $SnO_2 . Bi_2O_3$ | Pt (metal)/ $SnO_2$ |
| | 10 (Sn/Bi 4:1) | 80/10 |

EXAMPLE III

Titanium coupons were coated using the procedure of Example I, but employing a solution of $SnCl_4$ and $Bi(NO_3)_3$ to provide coatings containing 10 to 30 g/m$^2$ by metal of a solid solution of $SnO_2.Bi_2O_3$ in which the Sn/Bi ratio ranged from 9:1 to 4:1.

Some further cleaned and sandblasted titanium coupons were provided with a solid solution coating of $SnO_2.Bi_2O_3$ by plasma jet technique in an inert atmosphere, using mixed powders of $SnO_2$ and $Bi_2O_3$ and powders of pre-formed $SnO_2.Bi_2O_3$, having a mesh number of from 250 to 350. Pre-formed powders were prepared either by thermal deposition of $SnO_2.Bi_2O_3$ on an annealed support, stripping and grinding, or by grinding $SnO_2$ and $Bi_2O_3$ powders, mixing, heating in an inert atmosphere, and then grinding to the desired mesh number.

The anodes with an $SnO_2.Bi_2O_3$ coating obtained in either of these manners have a high oxygen overpotential and are useful for the production of chlorate and perchlorate, as well as for electrochemical polycondensations and organic oxidations.

We claim:

1. An ion selective anode comprising an electrically conductive substrate having a surface coating selected from (a) one or more platinum group metals, (b) one or more platinum group metal oxides, (c) mixtures of one or more platinum group metal oxides with one or more valve metal oxides, and (d) oxides of metals from the group consisting of chromium, molybdenum, tungsten, manganese, iron, cobalt, nickel lead, germanium, antimony, arsenic, zinc, cadmium, selenium and tellarium, said surface coating and conductive substrate being joined by an intermediate coating consisting of one or more layers of a solid solution of a mixture of tin dioxide and bismuth trioxide having a tin to bismuth metal weight ratio ranging from 1:10 to 100:1.

2. An ion selective anode as stated in claim 1 wherein said electrically conductive substrate is a valve metal.

3. An ion selective anode as stated in claim 2 wherein the tin to bismuth metal weight ratio ranges from 9:1 to 4:1.

4. An ion selective anode comprising an electrically conductive substrate having a surface coating selected from (a) one or more platinum group metals, (b) one or more platinum group metal oxides, (c) mixtures of one or more platinum group metal oxides with one or more valve oxides, and (d) oxides of metals from the group consisting of chromium, molybdenum, tungsten, manganese, iron, cobalt, nickel, lead, germanium, antimony, arsenic, zinc, cadmium, selenium and tellarium, said surface coating also containing from one to 20 percent by weight of a solid solution of a mixture of tin dioxide and bismuth trioxide having a tin to bismuth metal weight ratio ranging from 1:10 to 100:1.

5. An ion selective anode as stated in claim 4 wherein said electrically conductive substrate is a valve metal.

6. An ion selective anode as stated in claim 5 wherein the tin to bismuth metal weight ratio ranges from 9:1 to 4:1.

7. An ion selective anode comprising an electrically conductive valve metal substrate having a surface coating thereon containing, in parts by weight of the respective metal or metals: (a) 30–50 parts of ruthenium dioxide, (b) 30–60 parts of titanium dioxide, (c) 5–15 parts of a solid solution of tin dioxide and bismuth dioxide, and (d) 1–6 parts of cobalt oxide.

* * * * *

UNITED STATES PATENT AND TRADEMARK OFFICE

CERTIFICATE OF CORRECTION

PATENT NO. : 4,272,354

DATED : June 29, 1981

INVENTOR(S) : deNora et al

It is certified that error appears in the above–identified patent and that said Letters Patent are hereby corrected as shown below:

On the title page, please insert

" [30] Foreign Application Priority Data

March 28, 1978 [U.K.] United Kingdom Serial No.12053/78
March 27, 1979 [U.K.] United Kingdom Serial No. PCT/EP79/00021

Col. 1, line 22, correct spelling of "antimony"
Col. 6, line 18, insert comma after "nickel"
Col. 6, line 35, insert the word "metal" after the word "valve"

Signed and Sealed this

*Twentieth* Day of *July 1982*

[SEAL]

*Attest:*

GERALD J. MOSSINGHOFF

*Attesting Officer*

*Commissioner of Patents and Trademarks*